United States Patent [19]

Osborn

[11] Patent Number: 4,820,252

[45] Date of Patent: Apr. 11, 1989

[54] METHOD AND APPARATUS FOR FORMING A PAIR OF HEMS IN SUPERPOSED LAYERS OF A MOVING THERMOPLASTIC FILM WEB

[75] Inventor: Paul V. Osborn, Webster, N.Y.

[73] Assignee: Mobil Oil Corporation, New York, N.Y.

[21] Appl. No.: 195,915

[22] Filed: May 19, 1988

[51] Int. Cl.[4] ..... B65H 45/22

[52] U.S. Cl. ..... 493/440; 493/248

[58] Field of Search ..... 493/439, 440, 438, 416, 493/417, 446, 447, 455, 456, 476

[56] References Cited

U.S. PATENT DOCUMENTS 4,617,008 10/1986 Boyd et al. ..... 493/440

FOREIGN PATENT DOCUMENTS 2031363 1/1972 Fed. Rep. of Germany ..... 443/417

*Primary Examiner*—Frederick R. Schmidt
*Assistant Examiner*—Jack W. Lavinder
*Attorney, Agent, or Firm*—Alexander J. McKillop; Charles J. Speciale

[57] ABSTRACT

An improved method and apparatus for forming a pair of inwardly turned hems in the adjoining free edges of superposed layers of a longitudinally folded moving pliable material web, particularly superposed thermoplastic film panels for forming plastic bags having draw tapes in the hems. The moving web is passed over the cylindrical surface of a roller with the free edge of the inner layer of the web passing over a plurality of rollers disposed at one end of the first-named roller. The surfaces of the plurality of rollers extend substantially to the periphery of the roller. The free edge of the outer layer of the web is passed over a semicylindrical surface adjacent the plurality of rollers. The free edges of the layers of the web are guided to a hem folder at the downstream side of a hem forming block where they are folded inwardly adjacent the respective layers of the web to provide a pair of inwardly turned hems in the adjoining free edges of the opposing layers of the web.

14 Claims, 5 Drawing Sheets

METHOD AND APPARATUS FOR FORMING A PAIR OF HEMS IN SUPERPOSED LAYERS OF A MOVING THERMOPLASTIC FILM WEB

FIELD OF THE INVENTION

This invention relates to the forming of hems (i.e., turned edges) in superposed layers or panels of pliable materials such as thermoplastic films and fabrics and, in particular, to a method and apparatus for forming a pair of hems in a moving web of thermoplastic film by turning superposed, longitudinal edge portions of a pair of superposed panels of indeterminate length inwardly between the panels in the manufacture of draw tape plastic bags. The present invention is an improvement on the method and apparatus disclosed in U.S. Pat. No. 4,617,008—Boyd et al assigned to the assignee of the present application.

BACKGROUND OF THE INVENTION

In the manufacture of raw tape thermoplastic film bags, a channel or tunnel structure containing the draw tapes is provided around the mouth of the bag by hemming or turning in the edge portions of the two panels forming the front and back of the bag. A method and apparatus for providing these hems is disclosed in the aforesaid U.S. Pat. No. 4,617,008 and the disclosure is incorporated herein. In that patent a stationary plate and stationary triangles mounted on the plate are used to fold or otherwise direct the web of thermoplastic film during the folding operations. While the method and apparatus disclosed therein produce satisfactory draw tape bags, it has been found that for higher bag manufacturing speeds and for larger draw tape bags such as draw tape trash bags (i.e. more than 120 bags per minute and 24" wide bags) that the drag on the thermoplastic film passing over the stationary edges of the hem forming apparatus was so great that the tension resulting in the film in some instances caused a weakening of the bag material around the punched holes through which the draw tapes are pulled when the bag is closed.

SUMMARY OF THE INVENTION

It is an object of the present invention to form a pair of inwardly turned hems in the adjoining free edge portions of a once folded thermoplastic film web which is moving at high speed and to do so without substantially increasing the tension in the film.

In accordance with the present invention, there is provided an apparatus for forming a pair of inwardly turned hems in the adjoining free edges of superposed layers of a longitudinally folded moving pliable material web. The apparatus comprises a roller having a cylindrical surface over which the moving web passes, the web comprising an inner layer engaging the cylindrical surface of the roller and an outer layer superposed on the inner layer. Shaft means is provided at each end of the roller for supporting the roller on a horizontal axis. A forming block is positioned at one end of the roller for supporting an end of one of the shaft means, the block having at the one end a semi-cylindrical peripheral shape generally coaxial with the cylindrical surface of the roller, the block having a corresponding semi-cylindrical peripheral shape at the opposite end thereof and having an axis below the axis of the roller so that a semi-cylindrical surface is formed between the ends of the block extending at an acute angle with respect to the horizontal axis of the roller. One side of the block is upstream with respect to the moving web and the other side of the block is downstream with respect to the moving web. A plurality of upstream horizontal rollers is supported at the one end of the block and disposed around the axis of the first-named roller. The plurality of rollers includes upstream and downstream rollers, the surfaces of the upstream rollers extending substantially to the semi-cylindrical periphery of the block and the surfaces of the downstream rollers being recessed with respect to the semi-cylindrical periphery of the block. Means is supported adjacent the upstream side of the block for separating the free edges of the inner and outer layers of the web so that the inner layer of the web passes over the plurality of upstream rollers and the outer layer of the web passes over the separating means. A hem folder means is supported adjacent the downstream side of the block to receive the free edges of the layers of the web, the hem folder means comprising a plurality of spaced, flat parallel members being constructed and arranged to fold the free edge of the inner layer of the web inwardly adjacent the inner layer of the web to form a hem and to fold the free edge of the outer layer of the web inwardly against the outer layer of the web to form a hem to provide a pair of inwardly turned hems in the adjoining free edges of the opposing layers of the web.

In accordance with another aspect of the invention there is provided means for guiding the free edge of the inner layer of the web over the plurality of downstream rollers and means for guiding the free edge of the outer layer of the web over the semi-cylindrical surface at the one end of the block. In one form of the invention the means for guiding the free edges of the inner and outer layers of the web comprise a pair of wire guides mounted on the downstream side of the block and inserted into the hems as they are being formed.

In accordance with another aspect of the invention the hem folder means comprises an inner folding plate and an outer folding plate supported in spaced parallel relation and a pivoted film guide plate assembly comprising a pair of spaced guide members adapted to receive therebetween the inner and outer folding plates.

In accordance with another aspect of the invention there is provided operating means for pivoting the film guide assembly into and out of cooperating relation with respect to the inner and outer folding plates to permit the web to be threaded into the hem folder.

In accordance with another aspect of the invention there is provided a method for forming a pair of inwardly turned hems in the adjoining free edges of superposed layers of a longitudinally folded moving pliable web. The method comprises the steps of passing the moving web over the cylindrical surface of the horizontal roller, the web comprising an inner layer engaging the cylindrical surface of the roller and an outer layer superposed on the inner layer, passing the free edge of the inner layer of the web over a plurality of rollers disposed around the axis of the first-named roller at one end thereof, the surfaces of the plurality of rollers extending substantially to the periphery of the first-named roller, passing the free edge of the outer layer of the web over a semi-cylindrical surface adjacent the plurality of rollers and inclined at an acute angle with respect to the axis of the first-named roller, guiding the free edges of the layers of the web to a hem folder at the downstream side of the block and at the hem folder folding the free edge of the inner layer of the web inwardly adjacent the inner layer of the web to form a hem, and folding the free edge of the outer layer of the web inwardly against the outer layer of the web to form a hem to provide a pair of inwardly turned hems in the adjoining free edges of the opposing layers of the web.

For a more detailed disclosure of the invention and for further objects and advantages thereof, reference is to be had to the following description taken in conjunction with the accompanying drawings.

DESCRIPTION OF THE PREFERRED EMBODIMENT

Figures 1, 1A, 1B:
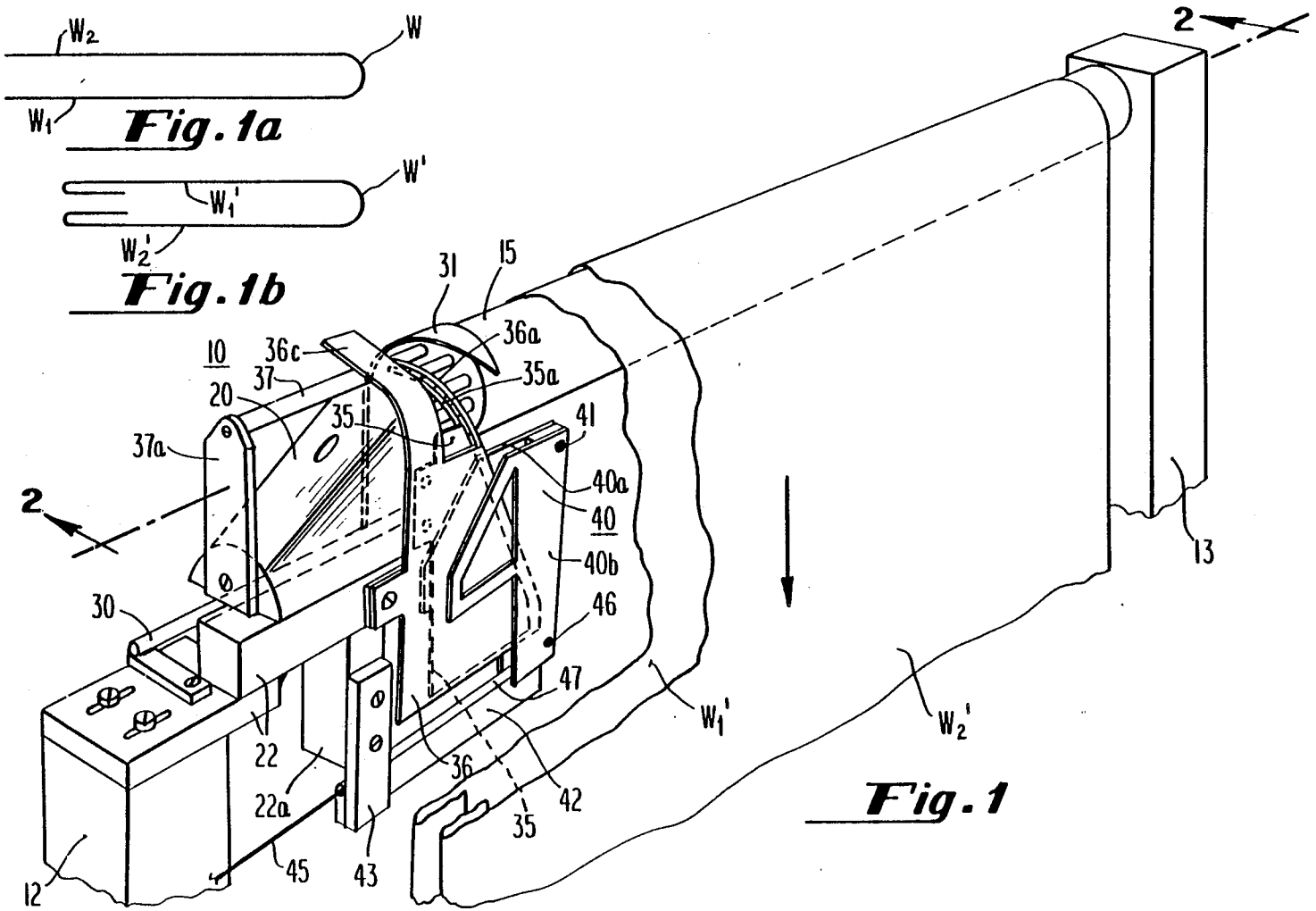
FIG. 1 is a perspective view of a hem folder for draw tape bags embodying the present invention.
FIG. 1*a* is a sectioned transverse view of the adjoining free edge portions of one folder thermoplastic film web prior to entering the hem folder of FIG. 1.
FIG. 1*b* is a sectional transverse view of a pair of inwardly turned hems in the adjoining free edge portions of a once folded thermoplastic film web leaving the hem folder shown in FIG. 1.
Figure 2:
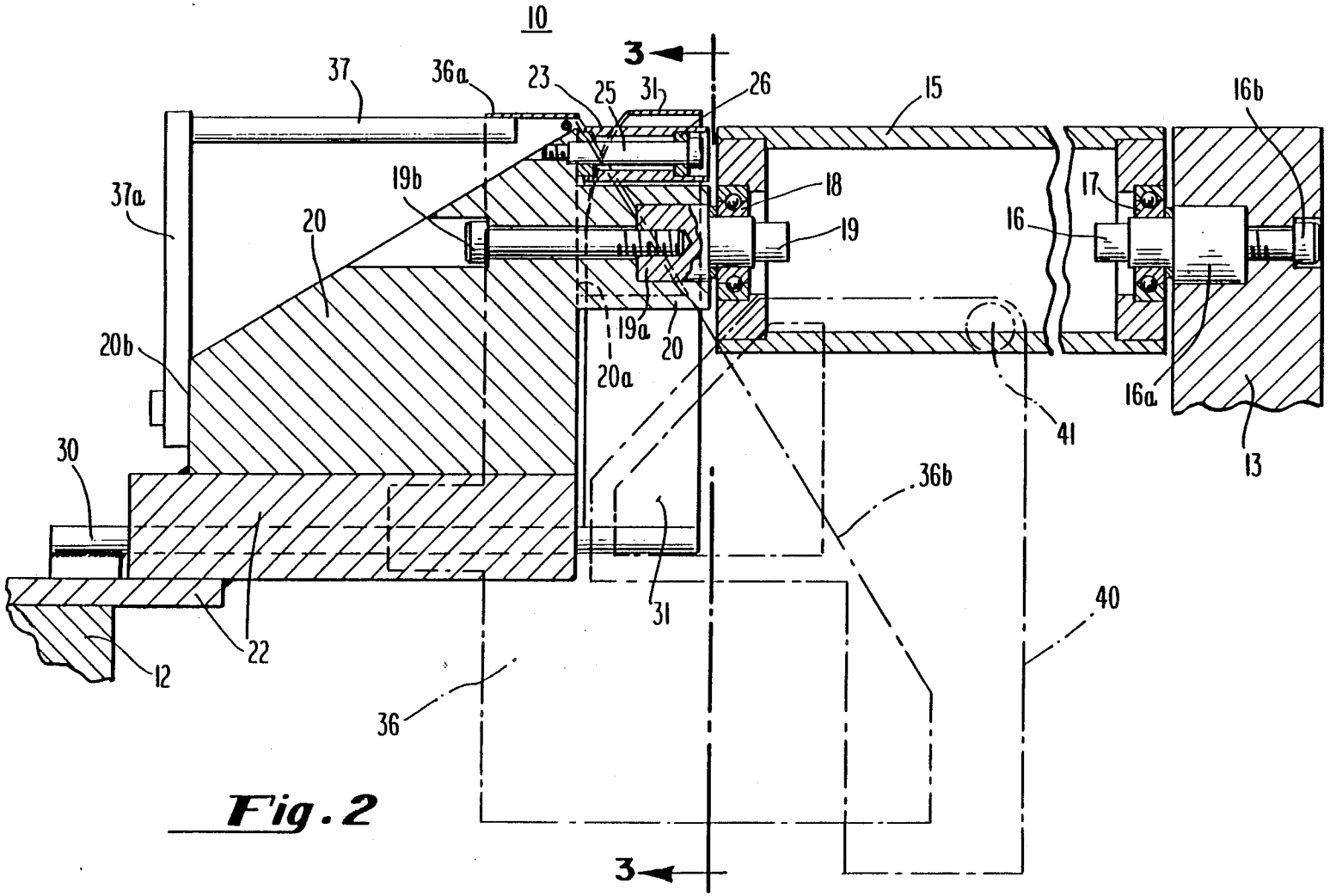
FIG. 2 is a vertical sectional view taken along the lines 2—2 in FIG. 1.

Referring to FIGS. 1 and 2 there is illustrated a unique hem folder 10 embodying the present invention and for practicing the hem folding method. The hem folder 10 is adapted to be positioned in a draw tape thermoplastic film bag manufacturing line such for example as shown in the aforementioned U.S. Pat. No. 4,617,008. The hem folder 10 is positioned in the line at the appropriate location to receive from upstream a continuous web W formed of two superposed layers or panels $W_1$ and $W_2$ of the longitudinally folded continuous sheet of pliable material. Each of the panels has a longitudinal free edge along the same side of the web. This is illustrated in FIG. 1*a* where the web W is shown in cross section with the reference character $W_1$ indicating the inner layer and the reference character $W_2$ indicating the outer layer and is the form of the web as it arrives from upstream in the line and enters the hem folder 10. After the web leaves the downstream side of the hem folder 10 the free edges of the web have inwardly turned hems as illustrated by the layers $W'_1$ and $W'_2$ in the cross section of the web W, shown in FIG. 1*b*.

As illustrated in FIGS. 1 and 2 the hem folder 10 is supported on a pair of spaced vertical supports 12 and 13. The web W is adapted to pass up and over the hem folder 10 in the direction of the arrows illustrated in FIGS. 1 and 3. As may be seen in FIG. 2 a roller 15 over which the web W passes is supported horizontally between the vertical support members 12 and 13. The support 13 carries a shaft 16 on which is mounted a roller bearing 17 carried by one end of the roller 15. The opposite end of the roller 15 is provided with the roller bearing 18 which is mounted on a shaft 19. Each of the shafts 16 and 19 include an eccentric portion 16*a* and 19*a* the purpose of which will be hereinafter described. The shaft 19 is mounted in a projection 20*c* on a film forming block 20 which in turn is mounted on a horizontally adjustable bracket 22 carried by the vertical support member 12.

As may be seen in FIGS. 1 and 2 the film forming block 20 includes an end 20*a* adjoining the roller 15 having a semi-cylindrical peripheral shape generally coaxial with the cylindrical surface of the roller 15. The other end 20*b* of the film forming block 20 also has a corresponding semicylindrical peripheral shape having an axis below the axis of the roller 15. The semi-cylindrical surface interconnecting the ends 20*a* and 20*b* of the block lies on an acute angle, for example approximately 30°, with respect to the horizontal axis of the roller. Mounted at the end 20*a* of the film forming block 20 is a plurality of horizontal rollers, 23, 24, the shafts 25 of which are arranged parallel to the horizontal axis of the roller 15. As shown in FIG. 2 the shaft 25 of each of the rollers 23, 24 is mounted on a pair of bearings 26. The diameters of the rollers 23 and 24 are substantially the same, with the diameters of the rollers 24 being slightly smaller. The surfaces of the upstream set of rollers 23, FIG. 3, extend substantially to the generally semi-cylindrical periphery of the end 20*a* of the film forming block 20 while the surfaces of the set of downstream rollers 24 are slightly recessed from the semicylindrical periphery to permit the insertion of a web folding member as hereinafter described.

Also mounted on the bracket 22 is a support rod 30 which has attached to its opposite end a curved film separator member 31. The film separator member 31 extends vertically upward from the support member 30 adjacent the upstream side of block 20 and curves around the outer surface of the rollers 23, 24, FIG. 1. As may be seen in FIG. 3, the film separator 31 separates the free edge of the inner layer $W_1$ of film from the free edge of the outer layer $W_2$ of film in the web W as it enters the hem folder 10. Thus the free edge of the inner layer $W_1$ of the web passes over the plurality of upstream rollers 23 and the free edge of the outer layer $W_2$ passes over the separator 31.

Figure 3:
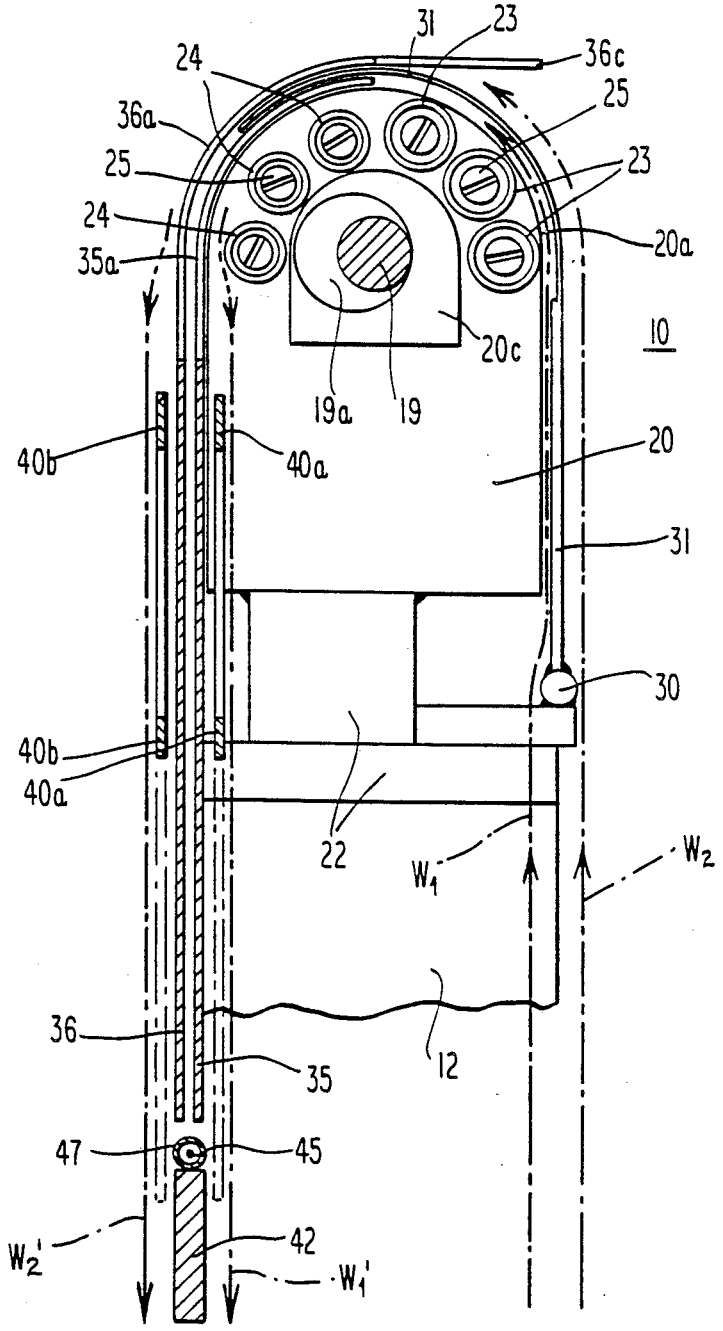
FIG. 3 is a sectional view taken along the lines 3—3 in FIG. 2.
Figure 4:
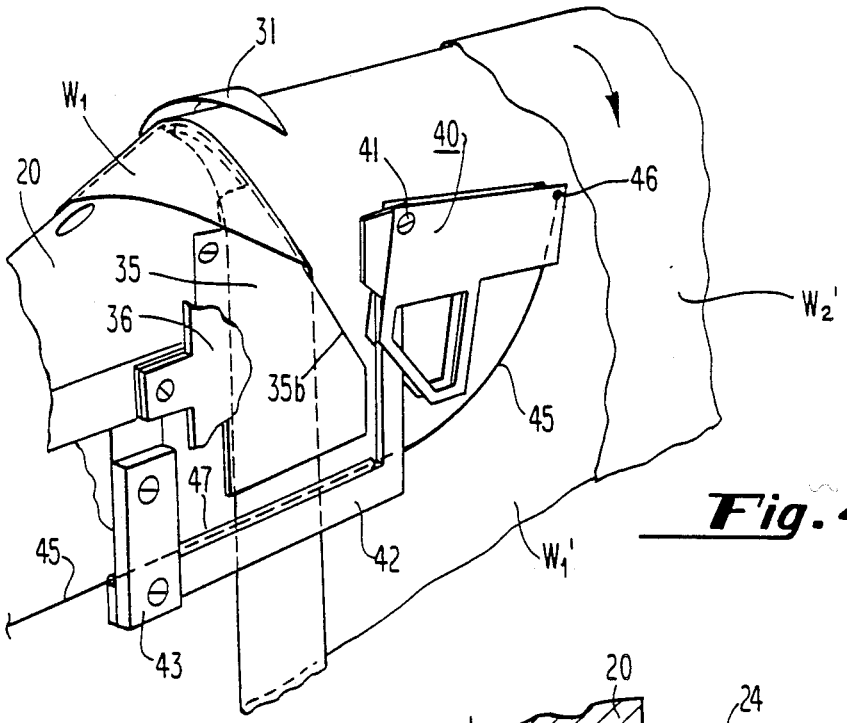
FIG. 4 is a fractional perspective view of the hem folder illustrated in FIG. 1 with parts broken away and the film guide in inactive position to show the formation of the hem in the inner layer of the web.
Figure 5:
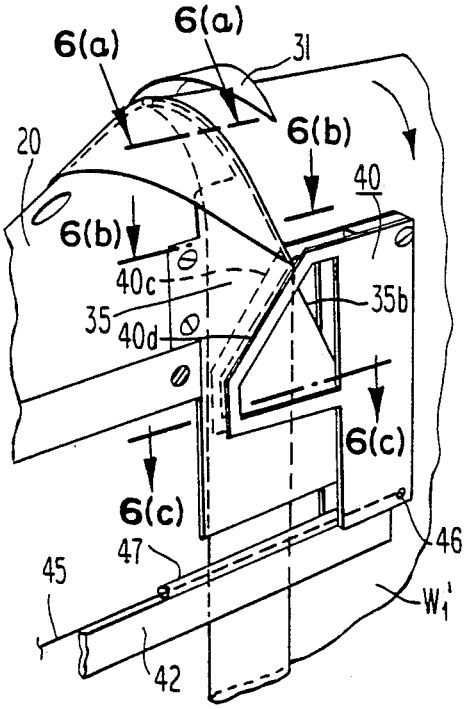
FIG. 5 is a fractional perspective view of the hem folder similar to FIG. 4 with the film guide in its active position.

Mounted at the downstream side of the film forming block 20, FIGS. 4 and 5, is an inner folding plate or blade 35 having an inner guide wire 35*a* extending therefrom. The guide wire 35*a* is curved and extends over the rollers 24, as shown in FIG. 3, which are slightly recessed as pointed out above. An outer folding plate or blade 36 is also mounted at the downstream side of the block 20 and is positioned over the inner folding plate 35. The outer folding plate 36 has a curved guide wire 36*a* extending therefrom which is adapted to aid in forming the hem in the outer layer $W_2$ of film in the web W, FIG. 7. As may be seen in FIG. 3, the inner and outer folding plates 35 and 36 are parallel and spaced from each other. The outer folding plate 36 has an extension 36*c* which engages a support arm 37 carried by a bracket 37*a* secured to the end 20*b* of the block 20. The support arm 37 aids in maintaining the folding plate 36 parallel to the folding plate 35 during the hem forming operation.

Cooperating with the inner and outer film folding plates 35 and 36 is a pivoted film guide assembly 40, FIG. 1, which comprises a pair of parallel spaced guide members $40_a$, $40_b$ carried by a pivot 41 which extends through the upper end of an L-shaped support 42, FIGS. 1 and 4 having the lower end secured by a bracket 43 to the bracket 22*a*. As may be seen in FIG. 1, the spaced guide members $40_a$, $40_b$ extend on either side of the inner and outer folding plates 35 and 36 and are parallel to each other. This is also illustrated in FIG. 3. The guide members $40_a$, $40_b$ may be pivoted about the pivot 41 by pushing the actuator 45, FIG. 1, which is attached at 46 to the lower end of the film guide assembly 40. The guide members $40_a$, $40_b$ are held together at 41 and 46 to form the assembly 40. The actuator 45 has been illustrated as a wire member which extends through a tube 47 carried by the support 42. When the actuator 45 is pushed inwardly, the film guides $40_a$, $40_b$ of the film guide assembly 40 are pivoted in a counter clockwise direction from the position illustrated in FIGS. 1 and 5 to the position illustrated in FIG. 4.

The operation of the hem folder apparatus 10 and the method of forming hems will now be described. Prior to entering the hem folder apparatus, the upstream folded web W comprising the inner layer $W_1$ and the outer layer $W_2$ has the cross sectional configuration diagrammatically illustrated in FIG. 1*a*. For purposes of explanation, the forming of the inwardly folded hem in the inner layer $W_1$ of the web is illustrated in FIGS. 4–6 and the forming of the inwardly folded hem in the outer layer $W_2$ of the web is illustrated in FIGS. 7–9.

Figure 6:
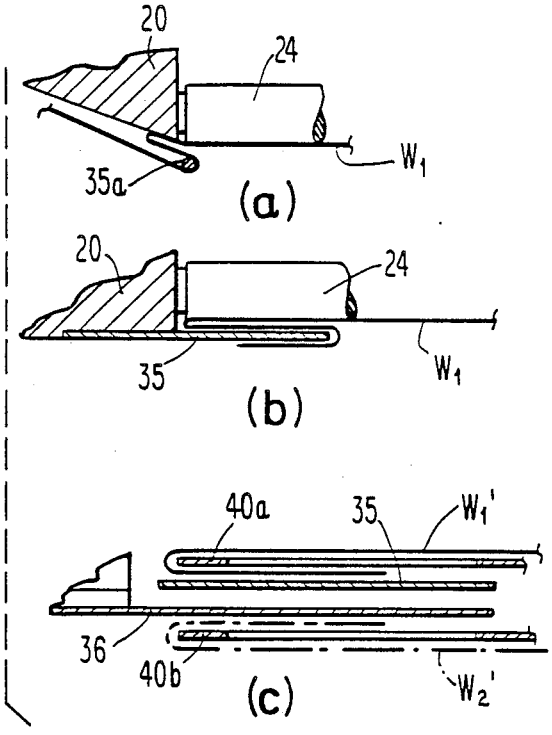
FIG. 6*a* is a sectional view along the lines 6*a*—6*a* in FIG. 5.
FIG. 6*b* is a sectional view taken along the lines 6*b*—6*b* in FIG. 5.
FIG. 6*c* is a sectional view taken along the lines 6*c*—6*c* in FIG. 5.

Referring to FIGS. 4–6, it will be seen that the inner layer $W_1$ passes over the roller 15 and the adjacent end of the hem folding block 20 where the longitudinal free edge of the inner layer $W_1$ is engaged by the wire 35*a* of the inner folding plate 35 and is folded inwardly toward the adjacent face of the inner layer of film $W_1$. The film guide assembly 40 in FIG. 4 has been pivoted to its inoperative position in order to permit the web of film W to be threaded into the hem folder apparatus. After the web has been threaded into the hem folder apparatus the film guide assembly 4 is pivoted about its pivot 41 to its operative position as shown in FIG. 5. As the web advances through the hem folder apparatus the longitudinal edge of the inner layer of film $W_1$ is guided by the wires 35*a* around the edge 35*b* of the folding plate 35 into its folded position where it passes through the film guide assembly 40.

The various steps in the folding operation are more clearly illustrated in FIGS. 6*a*–6*c*. In FIG. 6*a* it will be seen that the inner layer $W_1$ of the film has been engaged by the wire 35*a* of the inner folding plate 35 and is being moved inwardly toward the rollers 24. As the web $W_1$ continues to advance, the free edge of the web engages the edge 35*b* of the inner folding plate 35 thus forcing the free edge farther to the right as viewed in FIG. 6*b*. When the web $W_1$ reaches the position illustrated in FIG. 6*c* it will be seen that the free edge of the web $W_1$ has been completely folded in and the hem in the web is now folded about one of the film guides 40*a* of the film guide assembly 40. Since the hem has now been completely folded, the web is now identified with the reference character $W'_1$ similar to the identification used in FIG. 1*b*. Also the outer layer of the folded web has been illustrated in broken lines as $W'_2$ in FIG. 6*c*. Its folding operation will now be described.

Figure 7:
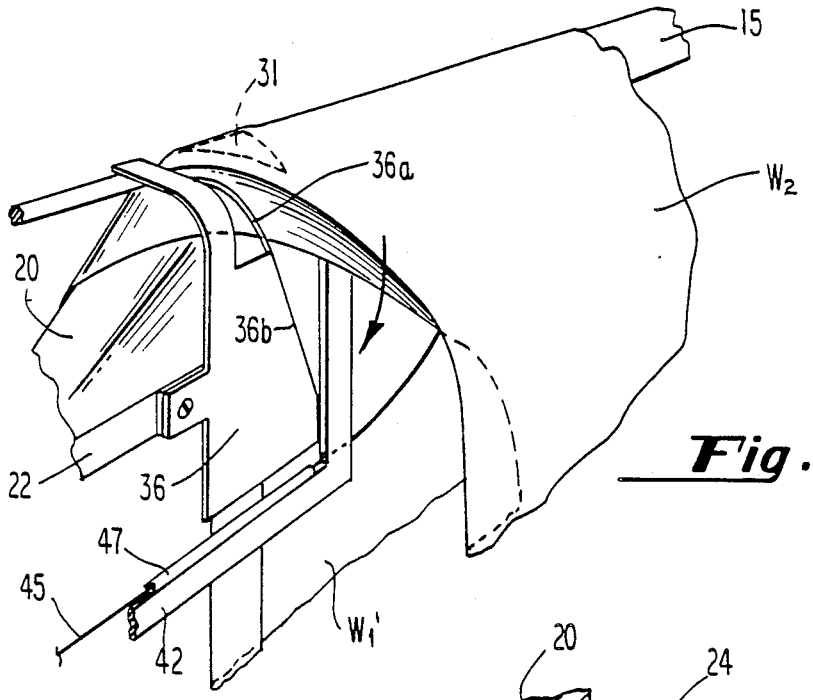
FIG. 7 is a fractional perspective view of the hem folder illustrated in FIG. 1 showing the threading of the outer layer of film into the hem folder film.
Figure 8:
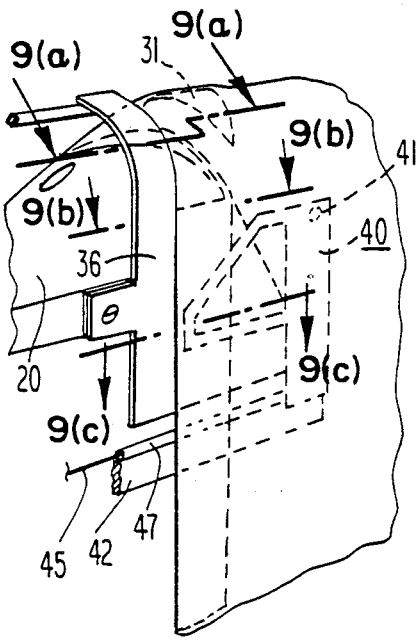
FIG. 8 is a fractional view of the hem folder similar to FIG. 7 with the film guide in its active position showing the outer layer of the thermoplastic film web with the hem formed therein.
Figure 9:
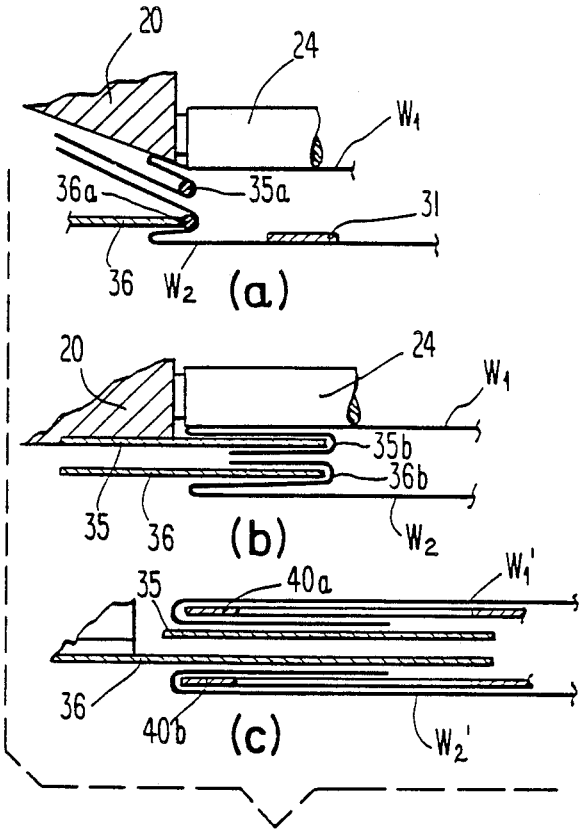
FIG. 9*a* is a sectional view taken along the lines 9*a*—9*a* in FIG. 8.
FIG. 9*b* is a sectional view taken along the lines 9*b*—9*b* in FIG. 8
FIG. 9*c* is a sectional view taken along the lines 9*c*—9*c* in FIG. 8 showing the cross section of the complete hems formed in both the inner and outer layers of the thermoplastic film web as the web passes through the hem folder of FIG. 1.

Referring to FIGS. 7–9 it will be seen that the outer layer $W_2$ of the web W is threaded into the hem folding apparatus 10 in the manner illustrated in FIG. 7. The outer layer $W_2$ passes over the film separator 31 and over the outer film plate 36 and the outer guide wire 36*a*. When the inner and outer layers of the web W have been threaded into the hem folding apparatus 10 the web will assume the position as illustrated in FIG. 8. As shown in FIG. 9*a* the longitudinal free edges of the inner layer $W_1$ and the outer layer $W_2$ are in their initial hem forming stages. The guide wire 35*a* is engaging the free edge of the inner web layer $W_1$ and the outer web guide wire 36*a* is engaging the longitudinal edge of the outer layer $W_2$ of the web. The film separator 31 is maintaining the outer web $W_2$ spaced from the inner web layer $W_1$. As shown in FIG. 9*b* the web W has advanced to the next location in the apparatus where the inner layer $W_1$ is engaged by the edge 35*b* of the inner folding plate 35 and the outer web layer $W_2$ has engaged the edge 36*b* the outer folding plate 36. In FIG. 9*c* the web W' has advanced to the position where the hems have been completely folded in both the inner web layer $W'_1$ and the outer web layer $W'_2$. It will be noted that the hems in the respective layers $W'_1$ and $W'_2$ have been folded about the spaced film guide members 40*a*, 40*b*. It will be seen in FIG. 9*c* that the cross section of the web W' with the hems folded in the respective layers $W_1$ and $W_2$ have the same configuration as referred to above and illustrated in FIG. 1*b*.

The guide wires 35*a* and 36*a* serve as an extension of the respective inner and outer plates 35 and 36 of the hem folder assembly and aid in tensioning the hems. More particularly, the wires 35*a* and 36*a* help to equalize the distances traveled by the inner and outer panels of the web as they pass over the forming block 20. This is accomplished by permitting the outer panel to take a shorter path more equal to the length of the path of the inner panel. It will be noted that the folding plates 35 and 36 have a substantially triangular shape with the folding edges 35*b*, 36*b*, over which the edge portions of the web pass, forming acute angles (i.e. approximately 60°) with respect to the horizontal. The film guide members 40*a* and 40*b* also have a triangular shape with the inclined edges 40*c* and 40*d* forming an angle of approximately 45° with the horizontal.

As pointed out above, each of the shafts 16 and 19 includes an eccentric portion 16*a* and 19*a* carried by the support 18 and the block 20 respectively. The eccentric portions of the shafts allow the axis and position of the roll 15 to be adjusted with respect to the block 20 and the rolls 23 and 24 carried thereby. This adjusts the tension in the hem folding area of the film going into the hem folder. By turning the eccentric portions 16*a* and 19*a* so that the roller 15 is further out this makes a longer path for the film and therefore the film in the hem is loosened by that effect. This is accomplished by turning the wrench flats on the eccentrics with a wrench until the correct setting is obtained and then locking the eccentrics in place with the locking screws **16*b* and 19*b* respectively shown in FIG. 2**.

It has been found that a hem folder embodying the present invention substantially reduces the draw o the film web independent of the film friction factor and hence the tension downstream from the hem folder during the manufacture of thermoplastic bags.

What is claimed is:

1. Apparatus for forming a pair of inwardly turned hems in the adjoining free edges of superposed layers of a longitudinally folded moving pliable material web comprising:

a roller having a cylindrical surface over which the moving web passes, the web comprising an inner layer engaging the cylindrical surface of said roller and an outer layer superposed on the inner layer;

shaft means at each end of said roller for supporting said roller on a horizontal axis;

a forming block at one end of said roller for supporting an end of one of said shaft means, said block having at said one end a semi-cylindrical peripheral shape generally coaxial with the cylindrical surface of said roller, said block having a corresponding semi-cylindrical peripheral shape at the opposite end and having an axis below the axis of said roller so that a semi-cylindrical surface is formed between said ends of said block extending at an acute angle with respect to the horizontal axis of said roller, one side of said block being upstream with respect to the moving web and the other side of said block being downstream with respect to the moving web;

a plurality of horizontal rollers supported at said one end of said block and disposed around the axis of said first-named roller said plurality of rollers including upstream and downstream rollers, the surfaces of said upstream rollers extending substantially to the semi-cylindrical periphery of said block and the surfaces of said downstream rollers being recessed with respect to the semi-cylindrical periphery of said block;

means supported adjacent the upstream side of said block for separating the free edges of the inner and outer layers of the web so that the inner layer of the web passes over said plurality of upstream rollers and the outer layer of the web passes over said separating means; and hem folder means supported adjacent the downstream side of said block to receive the free edges of the layers of the web, said hem folder means comprising a plurality of spaced parallel members being constructed and arranged to fold the free edge of the inner layer of the web inwardly adjacent the inner layer of the web to form a hem and to fold the free edge of the outer layer of the web inwardly against the outer layer of the web to form a hem to provide a pair of inwardly turned hems in the adjoining free edges of the opposing layers of the web.

2. Apparatus for forming a pair of inwardly turned hems according to claim 1 including means for guiding the free edge of the inner layer of the web over said plurality of downstream rollers; and means for guiding the free edge of the outer layer of the web over said semi-cylindrical surface at said one end of said block.

3. Apparatus for forming a pair of inwardly turned hems according to claim 1 wherein said shaft means at each end of said roller includes eccentric structure for adjusting the axis of said roller relative to the axis of said semi-cylindrical peripheral shape at said one end of said forming block.

4. Apparatus for forming a pair of inwardly turned hems according to claim 1 wherein said hem folder means comprises an inner folding plate having an edge for engaging the free edge of the inner layer of the web and an outer folding plate having an edge for engaging the free edge of the outer layer of the web, said inner and outer plates being supported in fixed spaced parallel relation at the downstream side of said block, and a pivoted film guide assembly comprising a pair of spaced guide plates with said inner and outer folding plates positioned therebetween.

5. Apparatus for forming a pair of inwardly turned hems according to claim 4 including operating means for pivoting said film guide assembly into and out of cooperating relation with said inner and outer folding plates.

6. Apparatus for forming a pair of inwardly turned hems according to claim 4 wherein each of said inner and outer folding plates has a wire member attached thereto, each said wire member being curved to extend around the surfaces of said downstream rollers at the location where said downstream rollers are recessed with respect to the semi-cylindrical periphery of said block.

7. Apparatus for forming a pair of inwardly turned hems according to claim 4 wherein said edges of said folding plates for engaging the respective layers of the web are inclined at an acute angle with respect to the horizontal.

8. Apparatus for forming a pair of inwardly turned hems according to claim 7 wherein said acute angle is approximately 60°.

9. Apparatus for forming a pair of inwardly turned hems in the adjoining free edges of superposed layers of a longitudinally folded moving thermoplastic film web comprising:

a roller having a cylindrical surface over which the moving web passes, the web comprising an inner layer engaging the cylindrical surface of said roller and an outer layer superposed on the inner layer;

a forming block supported at one end of said roller, said block having at said one end a semi-cylindrical peripheral shape generally coaxial with the cylindrical surface of said roller, one side of said block being upstream with respect to the moving web and the other side of said block being downstream with respect to the moving web;

a plurality of rollers supported at said one end of said block and disposed around the axis of said first-named roller, the surfaces of said rollers extending substantially to the semicylindrical periphery of said block;

means supported adjacent the upstream side of said block for separating the free edges of the inner and outer layers of the web so that the inner layer of the web passes over said plurality of rollers and the outer layer of the web passes over said separating means; and hem folder means supported adjacent the downstream side of said block to receive the free edges of the layers of the web, said hem folder means comprising an inner folding plate having an edge for engaging the free edge of the inner layer of the web and an outer folding plate having an edge for engaging the free edge of the outer layer of the web, said inner and outer plates being supported in fixed spaced parallel relation at the downstream side of said block, and a pivoted film guide assembly comprising a pair of spaced guide plates with said inner and outer folding plates positioned therebetween, said inner folding plate folding the free edge of the inner layer of the web inwardly adjacent the inner layer of the web to form a hem and the outer folding plate folding the free edge of the outer layer of the web inwardly against the outer layer of the web to form a hem to provide a pair of inwardly turned hems in the adjoining free edges of the opposing layers of the web.

10. Apparatus for forming a pair of inwardly turned hems according to claim 9 wherein said first named roller is mounted on a shaft including eccentric structure for adjusting the axis of said first-named roller relative to the axis of said semi-cylindrical peripheral shape at said one end of said forming block.

11. Apparatus for forming a pair of inwardly turned hems according to claim 9 including operating means for pivoting said film guide assembly into and out of cooperating relation with said inner and outer folding plates.

12. Apparatus for forming a pair of inwardly turned hems according to claim 9 including means for guiding the free edge of the inner layer of the web over said plurality of rollers; and means for guiding the free edge of the outer layer of the web over said semi-cylindrical surface at said one end of said block.

13. Apparatus for forming a pair of inwardly turned hems according to claim 9 wherein said edges of said folding plates for engaging the respective layers of the web are inclined at an acute angle with respect to the horizontal.

14. A method for forming a pair of inwardly turned hems in the adjoining free edges of superposed layers of a longitudinally folded moving pliable material web comprising the steps of:

passing the moving web over the cylindrical surface of a horizontal roller, the web comprising an inner layer engaging the cylindrical surface of the roller and an outer layer superposed on the inner layer;

passing the free edge of the inner layer of the web over a plurality of rollers disposed around the axis of the first-named roller at one end thereof, the surfaces of the plurality of rollers extending substantially to the periphery of the first-named roller;

passing the free edge of the outer layer of the web over a semi-cylindrical surface adjacent the plurality of rollers and inclined at an acute angle with respect to the axis of the first-named roller;

guiding the free edges of the layers of the web to a hem folder at the downstream side of the semi-cylindrical surface and at the hem folder folding the free edge of the inner layer of the web inwardly adjacent the inner layer of the web to form a hem; and folding the free edge of the outer layer of the web inwardly against the outer layer of the web to form a hem to provide a pair of inwardly turned hems in the adjoining free edges of the opposing layers of the web.

* * * * *